US009850693B2

(12) United States Patent
Stile

(10) Patent No.: US 9,850,693 B2
(45) **Date of Patent: *Dec. 26, 2017**

(54) ADJUSTABLE DOOR LOCK AND ASSOCIATED METHOD

(71) Applicant: Jason Stile, Katonah, NY (US)

(72) Inventor: Jason Stile, Katonah, NY (US)

(73) Assignee: AJUSTCO, LLC, Jersey City, NJ (US)

( * ) Notice: Subject to any disclaimer, the term of this patent is extended or adjusted under 35 U.S.C. 154(b) by 362 days.

This patent is subject to a terminal disclaimer.

(21) Appl. No.: 14/498,062

(22) Filed: Sep. 26, 2014

(65) Prior Publication Data

US 2015/0008682 A1 Jan. 8, 2015

Related U.S. Application Data

(63) Continuation of application No. 12/955,552, filed on Nov. 29, 2010, now Pat. No. 8,899,634.

(60) Provisional application No. 61/264,896, filed on Nov. 30, 2009.

(51) Int. Cl.

| | |
|---|---|
| ***E05C 1/04*** | (2006.01) |
| ***E05C 1/10*** | (2006.01) |
| ***E05C 1/00*** | (2006.01) |
| ***E05B 15/02*** | (2006.01) |

(52) U.S. Cl.

CPC ..... *E05C 1/10* (2013.01); *E05B 15/022* (2013.01); *E05C 1/004* (2013.01); *E05C 1/04* (2013.01); *E05B 2015/027* (2013.01); *Y10T 29/49895* (2015.01); *Y10T 292/096* (2015.04); *Y10T 292/1022* (2015.04); *Y10T 292/707* (2015.04)

(58) Field of Classification Search

USPC ..... 292/DIG. 26, 341.17

See application file for complete search history.

(56) References Cited

U.S. PATENT DOCUMENTS

| | | | | |
|---|---|---|---|---|
| 86,217 A * | 1/1869 | Davis | E05B 15/0245 | 292/341.19 |
| 114,841 A * | 5/1871 | Mitchell | E05B 15/0245 | 292/341.19 |
| 3,433,036 A * | 3/1969 | Brasseur | E05B 65/0811 | 292/126 |
| 8,272,169 B2 * | 9/2012 | Mandi | E05B 15/02 | 292/137 |

* cited by examiner

*Primary Examiner* — Mark Williams

(74) *Attorney, Agent, or Firm* — Najafi Law, PA; Ashkan Najafi

(57) ABSTRACT

An adjustable door lock may include a catch plate adapted to be secured adjacent to the door. A plurality of catch brackets may be connected to the catch plate. A catch may be adjustably connected to the catch plate and interfitted through the catch brackets. Such a catch preferably has a linear channel formed therein. A door plate may be disposed adjacent to the catch plate and adapted to be secured to the door. A locking bolt may further be housed within the door plate and may be linearly reciprocated along a first linear path passing through the door plate and the linear channel. In this way, the catch may be automatically adjusted along a second linear path orthogonally registered relative to the first linear path such that the linear channel automatically becomes axially aligned with the locking bolt as the locking bolt ingresses and egresses the catch.

14 Claims, 4 Drawing Sheets

ADJUSTABLE DOOR LOCK AND ASSOCIATED METHOD

CROSS REFERENCE TO RELATED APPLICATIONS

This is a continuation application of U.S. patent application Ser. No. 12/955,552, filed Nov. 29, 2010, currently pending, which claims the benefit of U.S. Provisional Application No. 61/264,896, filed Nov. 30, 2009, the entire disclosures which are both incorporated herein by reference in their entireties.

STATEMENT REGARDING FEDERALLY SPONSORED RESEARCH OR DEVELOPMENT

Not Applicable.

REFERENCE TO A MICROFICHE APPENDIX

Not Applicable.

BACKGROUND OF THE INVENTION

Technical Field

This invention relates to door locks and, more particularly, to an adjustable door lock for providing users with an easy and convenient means of locking offset and misaligned doors.

Prior Art

A barrel bolt is a sliding lock mechanism used to provide security for both average and heavy weight doors and windows. The bolt is surface mounted where the bolt slides into a catch on the other side of the door. Barrel bolts are most suitable for single leaf doors and passive leaf of double doors. They find wide application throughout industry and commerce; especially where a high level of physical security is required. These bolts are easy to fit and are available in a wide range of sockets. Some barrel bolts have spring action to hold the bolt in place while some others are lockable. These bolts are available in various sizes and come in various decorative finishes and with surface or universal strikes. Some barrel bolts are plain, simple looking while some others are highly decorative which are just perfect for installing on cabinet doors, windows etc.

Barrel bolts are installed on a variety of doors, and require high degree accuracy on installation, so that the bolt and catch align when engaged. Even when installed properly, the bolt and catch will become misaligned as the door and wall of the building shifts through use. This issue is common among barrel bolts, and to fix the issue homeowners or leasing managers must re-position the barrel bolt to realign, or find another inconvenient means of remedy. Usually either the lock or the catch has to be removed and the door and wall may require some annoying cosmetic repairs.

Accordingly, a need remains for a device in order to overcome the above-noted shortcomings. The present invention satisfies such a need by providing an adjustable door lock that is convenient and easy to use, lightweight yet durable in design, versatile in its applications, and designed for providing an easy means of locking offset and misaligned doors.

BRIEF SUMMARY OF THE INVENTION

In view of the foregoing background, it is therefore an object of the present invention to provide an apparatus for locking a misaligned or off-set door relative to support wall adjacent to the door. These and other objects, features, and advantages of the invention are provided by an adjustable door lock.

The adjustable door lock may include a catch plate adapted to be secured adjacent to the door. A plurality of catch brackets may be connected to the catch plate. A catch may be adjustably connected to the catch plate and interfitted through the catch brackets. Such a catch preferably has a linear channel formed therein. A door plate may be disposed adjacent to the catch plate and adapted to be secured to the door. A locking bolt may further be housed within the door plate and may be linearly reciprocated along a first linear path passing through the door plate and the linear channel. In this way, the catch may be automatically adjusted along a second linear path orthogonally registered relative to the first linear path such that the linear channel automatically becomes axially aligned with the locking bolt as the locking bolt ingresses and egresses the catch.

Through the effects of temperature fluctuations and structural stresses induced when constructing a building, there is a tendency for the doors of buildings to shift from their original positions thus causing these doors to be misaligned with its frame over time. The shifting may cause the locking bolts and catches of these doors to be misaligned thereby causing the doors to be unboltable. Such an arrangement disclosed provides the unexpected and unpredictable advantage of automatically aligning the locking bolt to the catch of these misaligned doors without the need for removing and refitting the locking bolt or catch.

The first linear path may further traverse the second linear path and may be bi-directional and oriented along a horizontal plane while the second linear path may be bi-directional and oriented along a vertical plane. In this way, the locking bolt may linearly traverse the second linear path upon ingressing and egressing the linear channel respectively while the catch brackets remain statically mated to the catch plate as the catch is displaced along the second linear path. Such an arrangement provides the unexpected and unpredictable advantage of providing a self-adjusting mechanism to the catch when a misaligned locking bolt is inserted into its linear channel.

The catch may include a plurality of guides diverging away from the linear channel towards the door plate for guiding the locking bolt along the linear channel. The plurality of guides may converge towards the linear channel away from the door plate for guiding the locking bolt along the linear channel. Such an arrangement provides the unexpected and unpredictable advantage of ensuring that the locking bolt is guided into the catch easily without requiring an added step of aligning the catch to the locking bolt by the user.

The locking bolt may include a handle such that the locking bolt may be rotated about the first linear path thereby displacing the handle between locked and unlocked positions relative to the door plate.

The disclose may include a method of utilizing an adjustable door lock for locking a misaligned or off-set door relative to support wall adjacent to the door. Such a method may include the chronological steps of: providing and securing a catch plate adjacent to the door; providing a plurality of catch brackets; providing a catch preferably having a linear channel formed therein; adjustably connecting the catch to the catch plate by interfitting the catch through the catch brackets; connecting the catch brackets to the catch plate; providing and disposing a door plate adjacent to the catch plate; providing and housing a locking bolt within the door plate; securing the door plate to the door; linearly reciprocating the locking bolt along a first linear path passing through the door plate and the linear channel; automatically adjusting the catch along a second linear path orthogonally registered relative to the first linear path by ingressing and egressing the locking bolt through the catch; and automatically and axially aligning the linear channel with the locking bolt.

There has thus been outlined, rather broadly, the more important features of the invention in order that the detailed description thereof that follows may be better understood, and in order that the present contribution to the art may be better appreciated. There are additional features of the invention that will be described hereinafter and which will form the subject matter of the claims appended hereto.

It is noted the purpose of the foregoing abstract is to enable the U.S. Patent and Trademark Office and the public generally, especially the scientists, engineers and practitioners in the art who are not familiar with patent or legal terms or phraseology, to determine quickly from a cursory inspection the nature and essence of the technical disclosure of the application. The abstract is neither intended to define the invention of the application, which is measured by the claims, nor is it intended to be limiting as to the scope of the invention in any way.

BRIEF DESCRIPTION OF THE SEVERAL VIEWS OF THE DRAWING

The novel features believed to be characteristic of this invention are set forth with particularity in the appended claims. The invention itself, however, both as to its organization and method of operation, together with further objects and advantages thereof, may best be understood by reference to the following description taken in connection with the accompanying drawings in which:

Figure 1:
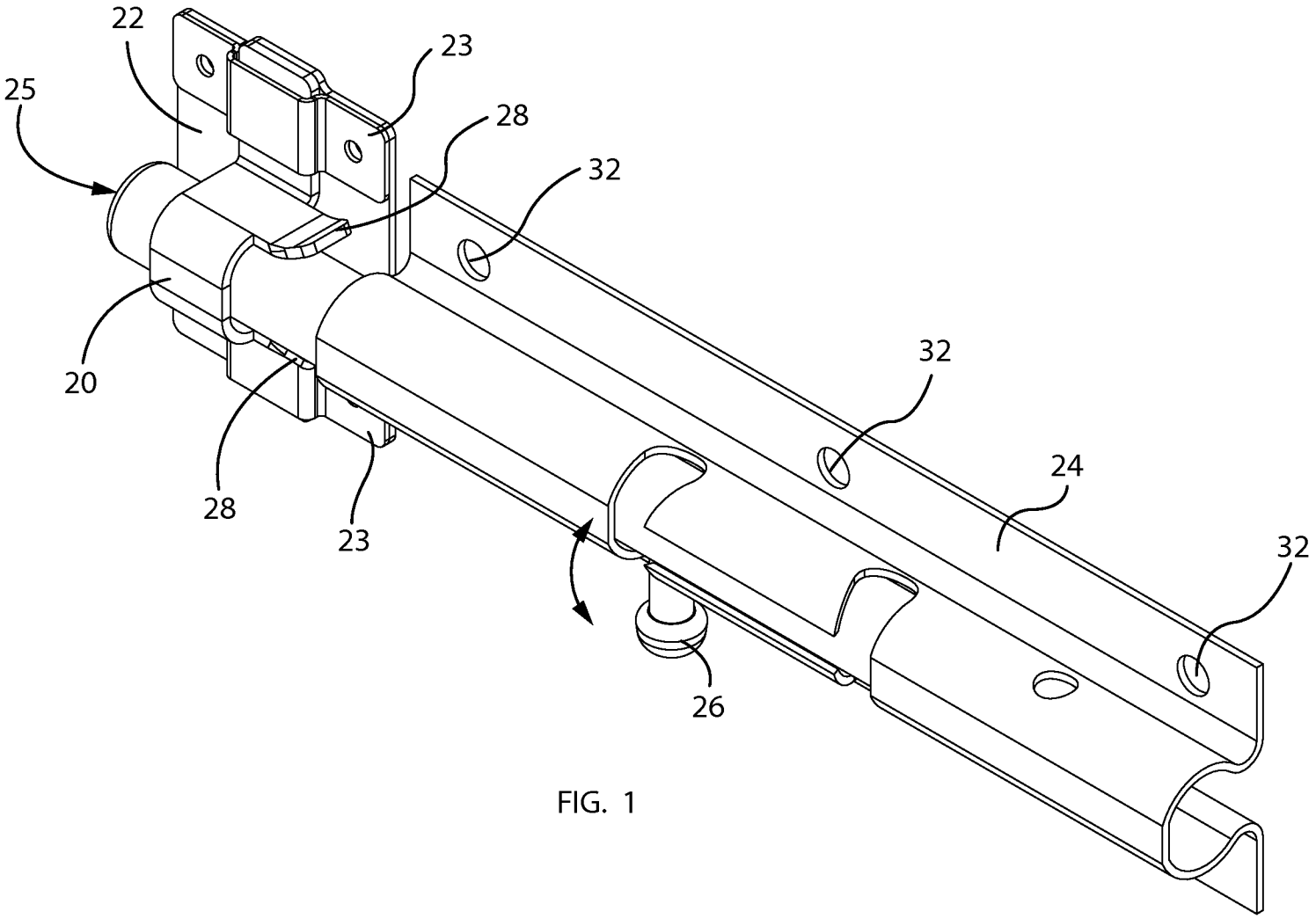
FIG. 1 is a perspective view showing an adjustable door lock in a locked position, in accordance with the present invention.

Those skilled in the art will appreciate that the figures are not intended to be drawn to any particular scale; nor are the figures intended to illustrate every embodiment of the invention. The invention is not limited to the exemplary embodiments depicted in the figures or the shapes, relative sizes or proportions shown in the figures.

DETAILED DESCRIPTION OF THE INVENTION

The present invention will now be described more fully hereinafter with reference to the accompanying drawings, in which a preferred embodiment of the invention is shown. This invention may, however, be embodied in many different forms and should not be construed as limited to the embodiment set forth herein. Rather, this embodiment is provided so that this application will be thorough and complete, and will fully convey the true scope of the invention to those skilled in the art. Like numbers refer to like elements throughout the figures.

The illustrations of the embodiments described herein are intended to provide a general understanding of the structure of the various embodiments. The illustrations are not intended to serve as a complete description of all of the elements and features of apparatus and systems that utilize the structures or methods described herein. Many other embodiments may be apparent to those of skill in the art upon reviewing the disclosure. Other embodiments may be utilized and derived from the disclosure, such that structural and logical substitutions and changes may be made without departing from the scope of the disclosure. Additionally, the illustrations are merely representational and may not be drawn to scale. Certain proportions within the illustrations may be exaggerated, while other proportions may be minimized. Accordingly, the disclosure and the figures are to be regarded as illustrative rather than restrictive.

One or more embodiments of the disclosure may be referred to herein, individually and/or collectively, by the term "present invention" merely for convenience and without intending to voluntarily limit the scope of this application to any particular invention or inventive concept. Moreover, although specific embodiments have been illustrated and described herein, it should be appreciated that any subsequent arrangement designed to achieve the same or similar purpose may be substituted for the specific embodiments shown. This disclosure is intended to cover any and all subsequent adaptations or variations of various embodiments. Combinations of the above embodiments, and other embodiments not specifically described herein, will be apparent to those of skill in the art upon reviewing the description.

The Abstract of the Disclosure is provided to comply with 37 C.F.R. §1.72(b) and is submitted with the understanding that it will not be used to interpret or limit the scope or meaning of the claims. In addition, in the foregoing Detailed Description, various features may be grouped together or described in a single embodiment for the purpose of streamlining the disclosure. This disclosure is not to be interpreted as reflecting an intention that the claimed embodiments require more features than are expressly recited in each claim. Rather, as the following claims reflect, inventive subject matter may be directed to less than all of the features of any of the disclosed embodiments. Thus, the following claims are incorporated into the Detailed Description, with each claim standing on its own as defining separately claimed subject matter.

The below disclosed subject matter is to be considered illustrative, and not restrictive, and the appended claims are intended to cover all such modifications, enhancements, and other embodiments which fall within the true scope of the present invention. Thus, to the maximum extent allowed by law, the scope of the present invention is to be determined by the broadest permissible interpretation of the following claims and their equivalents, and shall not be restricted or limited by the foregoing detailed description.

The device of this invention is referred to generally in FIGS. 1-5 and is intended to provide an adjustable door lock. It should be understood that the present invention may be used to provide a door lock for off-set and misaligned doors as well as different types of movable barriers, and should not be limited to the uses described herein.

Referring to FIGS. 1-5, the adjustable door lock 10 may include a catch plate 22 adapted to be secured adjacent to a door (not shown), such as a wall or a portion of a door frame.

Figure 4:
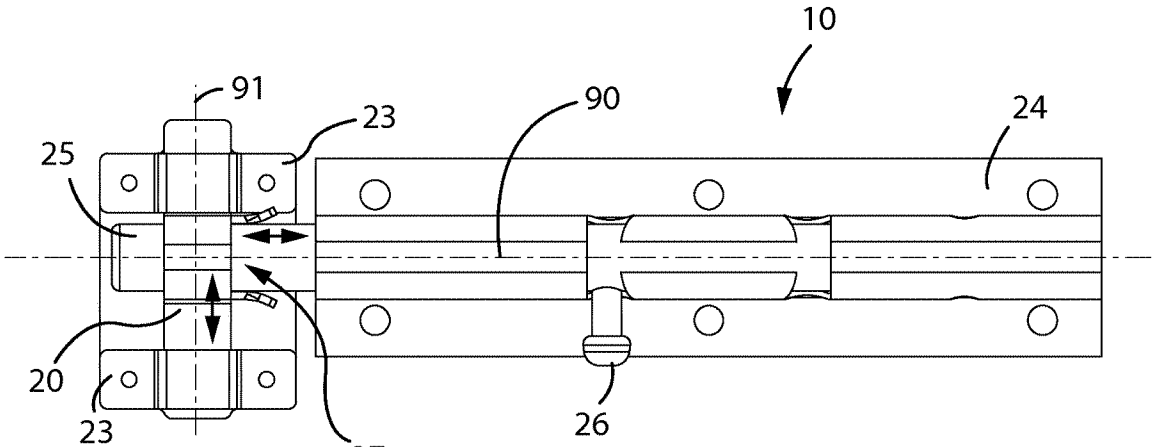
FIG. 4 is a front elevational view of the adjustable door lock showing the catch upwardly aligned relative to the locking bolt.
Figure 5:
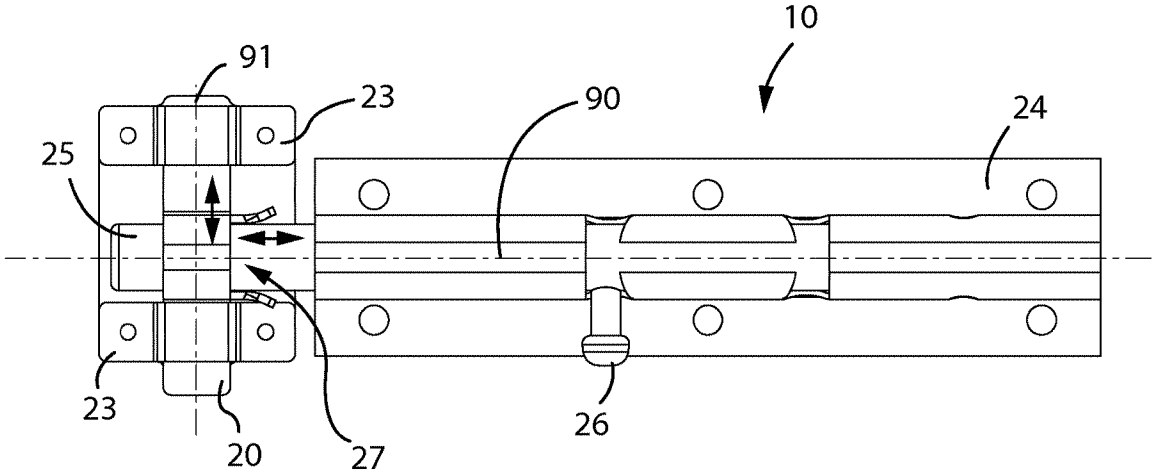
FIG. 5 is front elevational view of the adjustable door lock showing the catch downwardly aligned relative to the locking bolt.

A plurality of catch brackets 23 may be connected to the catch plate 22. A catch 20 may be adjustably connected to the catch plate 22 and interfitted through the catch brackets 23. Such a catch 20 preferably has a linear channel 27 formed therein. A door plate 24 may be disposed adjacent to the catch plate 22 and adapted to be secured to the door (not shown). As best shown in FIGS. 4 and 5, a locking bolt 25 may be housed within the door plate 24 and may be linearly reciprocated along a first linear path 90 passing through the door plate 24 and the linear channel 27. Such a structural arrangement provides the unpredicted and unexpected advantage of automatically adjusting the catch 20 along a second linear path 91 that is orthogonally registered relative to the first linear path 90 such that the linear channel 27 automatically becomes axially aligned with the locking bolt 25 as the locking bolt 25 ingresses and egresses the catch 20.

From exposure to temperature fluctuations and structural stresses during building construction, doors/frames shift from their original positions and thereby become misaligned over time. Such misalignment causes conventional locking bolts and catches to become misaligned thereby preventing easy locking/unlocking. The present disclosure provides the unexpected and unpredictable advantage of automatically aligning the locking bolt 25 with the catch 20 during such misalignment without the need for removing and refitting the locking bolt 25 or catch 20.

Referring to FIGS. 4 and 5, the first linear path 90 may traverse the second linear path 91 and may be bi-directionally oriented along a horizontal plane while the second linear path 91 may be bi-directionally oriented along a vertical plane. In this way, the locking bolt 25 may linearly traverse the second linear path 91 upon ingressing and egressing the linear channel 27 respectively, while the catch brackets 23 remain statically mated to the catch plate 22 as the catch 20 is displaced along the second linear path 91. Such an arrangement provides the unexpected and unpredictable advantage of providing a self-adjusting catch 20 when a misaligned locking bolt 25 is inserted into its linear channel 27, without undesirably shifting the catch brackets 23.

Figure 2:
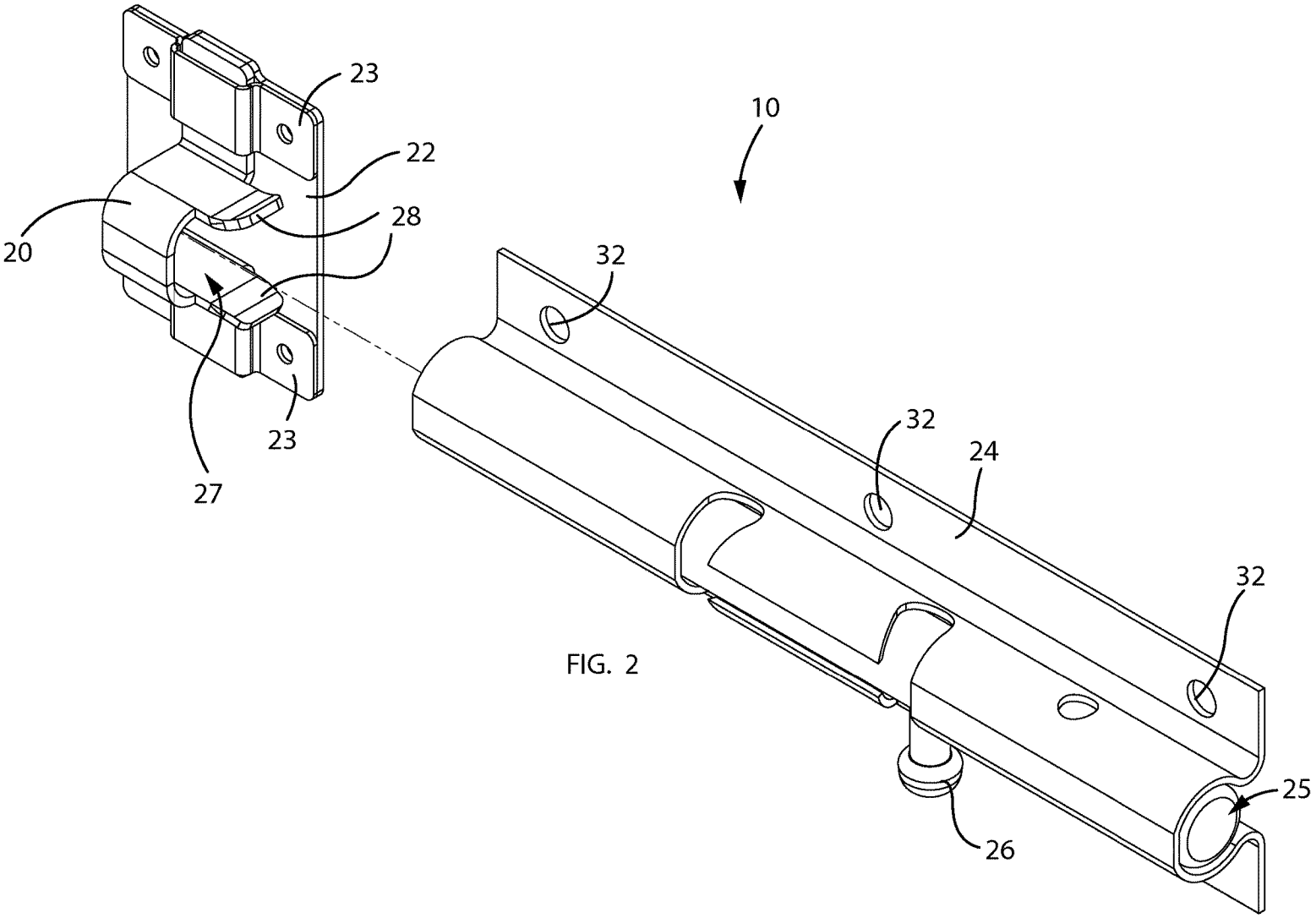
FIG. 2 is an exploded view of the adjustable door lock shown at an unlocked position.
Figure 3:
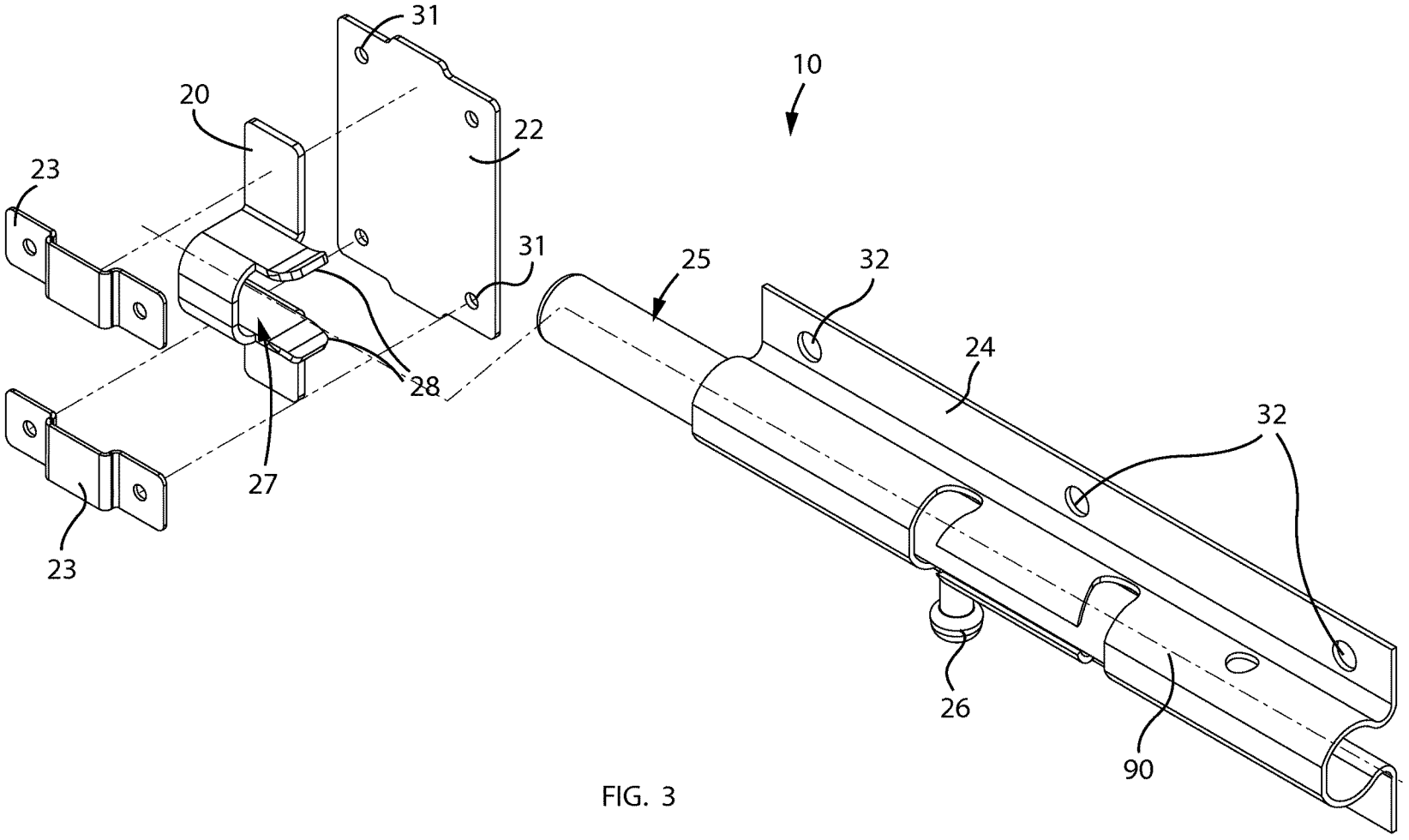
FIG. 3 is an exploded view of the adjustable door lock shown in FIG. 1.

Referring to FIGS. 1-3, the catch 20 may include a plurality of guides 28, diverging away from the linear channel 27 and towards the door plate 24 for guiding the locking bolt 25 along the linear channel 27. Such guides 28 preferably converge towards the linear channel 27 and away from the door plate 24 for guiding the locking bolt 25 along the linear channel 27. Such a structural arrangement provides the unexpected and unpredictable advantage of ensuring locking bolt 25 is smoothly guided into the catch 20 without requiring an added step of aligning the catch 20 to the locking bolt 25 by the user.

Referring to FIGS. 1-3 again, the locking bolt 25 may include a handle 26 such that locking bolt 25 may be rotated about the first linear path 90 (see FIG. 3) thereby displacing the handle 26 between locked and unlocked positions relative to the door plate 24. Such a structural arrangement provides the benefit of freely rotating locking bolt 25 while ingressed and egressed from linear channel 27.

The present disclosure may include a method of utilizing an adjustable door lock 10 for locking a misaligned or off-set door relative to support wall adjacent to the door. Such a method may include the chronological steps of: providing and securing a catch plate 22 adjacent to the door; providing a plurality of catch brackets 23; providing a catch 20 preferably having a linear channel 27 formed therein; connecting the catch brackets 23 to the catch plate 22; and adjustably connecting the catch 20 to the catch plate 22 by interfitting the catch 20 through the catch brackets 23.

Such a method may further include the chronological steps of: providing and disposing a door plate 24 adjacent to the catch plate 22; providing and housing a locking bolt 25 within the door plate 24; securing the door plate 24 to the door; linearly reciprocating the locking bolt 25 along a first linear path 90 passing through the door plate 24 and the linear channel 27; automatically adjusting the catch 20 along a second linear path 91 orthogonally registered relative to the first linear path 90 by ingressing and egressing the locking bolt 25 through the catch 20; and automatically and axially aligning the linear channel 27 with the locking bolt 25.

As a non-limiting example, the catch plate 22 may further include a plurality of holes 31 such that a plurality of screws may be inserted to fixedly engage the catch plate 22 with a door frame. Guides 28 may extend outwardly from the linear channel 27 such that the distal end portions of the guides 28 may be wider than the linear channel 27. In this way, the guides 28 may form a generally "V" shaped path thereby enabling the locking bolt 25 to slidably enter the linear channel 27 and may easily secure the locking bolt 25 to a locked position. As noted hereinabove, catch 20 is slidably mated to the catch plate 22 by catch brackets 23 such that the catch 20 is automatically aligned with the locking bolt 25 even if there is a change in the door alignment relative to the linear channel 27.

As a non-limiting example, locking bolt 25 may be slidably enclosed within the linear channel 27 formed on the first linear path 90 of the door plate 24. The locking bolt handle 26 may be fixedly mated to the locking bolt 25 such that the handle 26 may be slidably engaged with the catch 20 in a locked and an unlocked position on the door plate 24. Referring to FIGS. 1-3, the door plate 24 may include a plurality of holes 32 that receive fasteners to engage the door plate 24 fixedly with a door.

Notably, the locking door mechanism 10 may advantageously allows the catch 20 and the locking bolt 25 to be automatically adjusted to compensate for any misalignment of the door relative to a support surface during extended use.

While the invention has been described with respect to a certain specific embodiment, it will be appreciated that many modifications and changes may be made by those skilled in the art without departing from the spirit of the invention. It is intended, therefore, by the appended claims to cover all such modifications and changes as fall within the true spirit and scope of the invention. In particular, with respect to the above description, it is to be realized that the optimum dimensional relationships for the parts of the present invention may include variations in size, materials, shape, form, function and manner of operation.

What is claimed as new and what is desired to secure by Letters Patent of the United States is:

1. An adjustable door lock for locking a misaligned door relative to a support wall adjacent to the door, said adjustable door lock comprising:

a catch plate;

a plurality of catch brackets engaged with said catch plate;

a catch interfitted between said catch plate and said catch brackets, said catch having a channel formed in said catch and located anterior of said catch plate;

a door plate; and a locking bolt displaced along a first path passing at least partially along said door plate and said channel, said locking bolt being disposed anterior of said catch plate;

wherein, when said locking bolt is displaced along said first path, said locking bolt at least partially passes along said door plate and said channel such that said locking bolt contacts said catch and causes said catch to automatically adjust along a second path anterior of said catch plate;

wherein said first path is bi-directional and oriented along a horizontal plane while said second path is bi-directional and oriented along a vertical plane;

wherein said catch is connected to said catch plate.

2. The adjustable door lock of claim 1, wherein said first path traverses said second path.

3. The adjustable door lock of claim 1, said locking bolt traverses said second path upon ingressing and egressing said channel respectively.

4. The adjustable door lock of claim 1, wherein said catch brackets remain statically mated to said catch plate as said catch is displaced along said second path.

5. The adjustable door lock of claim 1, wherein said catch comprises:

a plurality of guides diverging away from an anterior face of said channel towards said door plate and thereby guiding said locking bolt along said channel.

6. The adjustable door lock of claim 5, wherein said guides converge towards said channel away from said door plate for guiding said locking bolt along said channel.

7. The adjustable door lock of claim 1, wherein said locking bolt includes a handle, said locking bolt being rotated about said first path thereby displacing said handle between locked and unlocked positions relative to said door plate.

8. An adjustable door lock for locking a misaligned door relative to a support wall adjacent to the door, said adjustable door lock comprising:

a catch plate adapted to be secured adjacent to the door;

a plurality of catch brackets connected to an anterior face of said catch plate;

a catch positioned at said anterior face of said catch plate and adjustably interfitted through said catch brackets, said catch having a channel formed in said catch and extending substantially parallel to said anterior face of said catch plate;

a door plate adapted to be secured to the door; and a locking bolt positioned at said door plate and reciprocated along a first path disposed anterior of said catch plate;

wherein, as said locking bolt at least partially ingresses said catch, said locking bolt contacts said catch and thereby automatically adjusts said catch along a second path anterior of said catch plate and orthogonally registered relative to said first path such that said channel automatically aligns with said locking bolt;

wherein said first path is bi-directional and oriented along a horizontal plane while said second path is bi-directionally linear and oriented along a vertical plane;

wherein said catch is connected to said catch plate.

9. The adjustable door lock of claim 8, wherein said first path is linear and traverses said second path.

10. The adjustable door lock of claim 8, said locking bolt linearly traverses said second path upon ingressing and egressing said channel respectively.

11. The adjustable door lock of claim 8, wherein said catch brackets remain statically mated to said catch plate as said catch is displaced along said second path.

12. The adjustable door lock of claim 8, wherein said catch comprises:

a plurality of guides diverging away from said channel towards said door plate for guiding said locking bolt along said channel.

13. The adjustable door lock of claim 12, wherein said guides converge towards said channel away from said door plate for guiding said locking bolt along said channel.

14. The adjustable door lock of claim 8, wherein said locking bolt includes a handle, said locking bolt being rotated about said first path thereby displacing said handle between locked and unlocked positions relative to said door plate.

* * * * *